US005529417A

United States Patent [19]

Burrlader

[11] Patent Number: 5,529,417

[45] Date of Patent: Jun. 25, 1996

[54] NAIL POLISH BOTTLE WITH A COLOR MATCHING EXTENSION CAP

[76] Inventor: Alex C. Burrlader, 16345 W. Dixie Hwy Suite. 136, North Miami Beach, Fla. 33160

[21] Appl. No.: 360,167

[22] Filed: Dec. 20, 1994

[51] Int. Cl.[6] ..... A45D 34/00

[52] U.S. Cl. ..... 401/129; 132/73; 401/194; 434/100

[58] Field of Search ..... 434/100; 132/73, 132/73.5, 75; 401/129, 194

[56] References Cited

U.S. PATENT DOCUMENTS

| | | | |
|---|---|---|---|
| 2,032,807 | 3/1936 | Masbach | 132/73 X |
| 2,237,162 | 4/1941 | Robinson | 434/100 |
| 2,296,139 | 9/1942 | Blair | 434/100 |
| 3,451,399 | 6/1969 | Schmieding | 132/73 |

FOREIGN PATENT DOCUMENTS

| | | | |
|---|---|---|---|
| 611602 | 11/1948 | United Kingdom | 132/73 |

*Primary Examiner*—Steven A. Bratlie

[57] ABSTRACT

A nail polish bottle with a color matching extension cap comprising: a nail polish bottle having a roof, a floor and at least one side wall extending therebetween, the bottle including an aperture, a neck extending from the bottle around the aperture thereof, the neck including a coupling device affixed thereto; and an extension cap having an upper region and a lower region, the upper region of the cap having an open end at its uppermost extent, the upper region including a colored section resembling a colored fingernail, the lower region including a coupling device and adapted to be releasably coupled to the neck of the bottle, a brush being formed in an elongated configuration and affixed within the lower region of the cap, the brush having a plurality of hairlike bristles extending therefrom, the brush extending through the aperture in the roof and neck.

1 Claim, 3 Drawing Sheets

NAIL POLISH BOTTLE WITH A COLOR MATCHING EXTENSION CAP

BACKGROUND OF THE INVENTION

1. Field of the Invention

The present invention relates to a nail polish bottle with a color matching extension cap and more particularly pertains to inserting the finger tip of the user into the apparatus to determine how a particular color of polish would look on the user's finger.

2. Description of the Prior Art

The use of containers for nail polish is known in the prior art. More specifically, containers for nail polish heretofore devised and utilized for the purpose of storing and dispensing nail polish are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. Des. 316,034 to DeGaetano a nail polish bottle.

U.S. Pat. No. 4,733,788 to D'Amico discloses a dripless fingernail polish bottle.

U.S. Pat. No. 4,927,282 to Moranne et al. discloses a container for nail polish.

U.S. Pat. No. Des. 325,523 to Restrepo discloses a nail polish container.

Lastly, U.S. Pat. No. 4,280,629 to Slaughter discloses a container for nail polish or the like.

In this respect, the nail polish bottle with a color matching extension cap according to the present invention substantially departs from the conventional concepts and designs of the prior art, and in doing so provides an apparatus primarily developed for the purpose of inserting the finger tip of the user into the apparatus to determine how a particular color of polish would look on the user's finger.

Therefore, it can be appreciated that there exists a continuing need for a new and improved nail polish bottle with a color matching extension cap which can be used for inserting the finger tip of the user into the apparatus to determine how a particular color of polish would look on the user's finger. In this regard, the present invention substantially fulfills this need.

SUMMARY OF THE INVENTION

In view of the foregoing disadvantages inherent in the known types of containers for nail polish now present in the prior art, the present invention provides an improved nail polish bottle with a color matching extension cap. As such, the general purpose of the present invention, which will be described subsequently in greater detail, is to provide a new and improved nail polish bottle with a color matching extension cap and method which has all the advantages of the prior art and none of the disadvantages.

To attain this, the present invention essentially comprises a new and improved nail polish bottle with a color matching extension cap, the apparatus comprising, in combination: a nail polish bottle having a roof, a floor and a cylindrical side wall extending therebetween, the roof being formed in a planar generally oval configuration and having a circular aperture at its center point, an upperwardly extending neck being positioned around the aperture, the neck being formed in a generally cylindrical configuration and having a plurality of external screw threads, the neck including an axially positioned aperture extending therethrough, the neck communicating with the interior of the bottle through the circular aperture in the roof,the bottle being fabricated of a transparent material, the bottle being filled with a particular color of nail polish, the transparent bottle enabling the user to view the color of the nail polish through the bottle; and an extension cap formed in a generally cylindrical configuration, the extension cap having an upper region, a lower region and a central region therebetween, the lower region having a plurality of internal screw threads, the lower region adapted to be coupled to the neck of the bottle, the central region of the apparatus being solid, a brush being formed in an elongated generally cylindrical configuration, the lowermost extent of the brush having a plurality of hairlike bristles extending therefrom, the uppermost extent of the brush being affixed to the lowermost extent of the central region of the cap, the brush extending through the aperture in the roof and neck, the bristles being positioned in the lowermost extent of the nail polish bottle, the brush adapted to enable the user to apply nail polish to the fingernail of a person in a smooth and efficient manner; and the upper region of the extension cap having a hollow generally cylindrical sidewall, the upper region having an open end at its uppermost extent and a closed end at its lowermost extent, the closed end being formed contiguously with the uppermost extent of the central region, the cylindrical sidewall including a generally semi-oval shaped colored section resembling a colored fingernail, the colored section being of the same hue as the nail polish in the bottle, the colored section being formed contiguously with the uppermost extent of the upper region, the apparatus enabling the user to insert a finger and determine how a particular color of nail polish would look on their fingernail without having to paint the fingernail.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved nail polish bottle with a color matching extension cap which has all of the advantages of the prior art containers for nail polish and none of the disadvantages.

It is another object of the present invention to provide a new and improved nail polish bottle with a color matching extension cap which may be easily and efficiently manufactured and marketed.

it is further object of the present invention to provide a new and improved nail polish bottle with a color matching extension cap which is of durable and reliable constructions.

An even further object of the present invention is to provide a new and improved nail polish bottle with a color matching extension cap which is susceptible of a low cost of manufacture with regard to both materials and labor, and which accordingly is then susceptible of low prices of sale to the consuming public, thereby making such nail polish bottle with a color matching extension cap economically available to the buying public.

Still yet another object of the present invention is to provide a new and improved nail polish bottle with a color matching extension cap which provides in the apparatuses and methods of the prior art some of the advantages thereof, while simultaneously overcoming some of the disadvantages normally associated therewith.

Still another object of the present invention is to insert the finger tip of the user into the apparatus to determine how a particular color of polish would look on the user's finger.

Lastly, it is an object of the present invention to provide a new and improved nail polish bottle with a color matching extension cap comprising: a nail polish bottle having a roof, a floor and at least one side wall extending therebetween, the bottle including an aperture, a neck extending from the bottle around the aperture thereof, the neck including a coupling device affixed thereto; and an extension cap having an upper region and a lower region, the upper region of the cap having an open end at its uppermost extent, the upper region including a colored section resembling a colored fingernail, the lower region including a coupling device and adapted to be releasably coupled to the neck of the bottle, a brush being formed in an elongated configuration and affixed within the lower region of the cap, the brush having a plurality of hairlike bristles extending therefrom, the brush extending through the aperture in the roof and neck.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
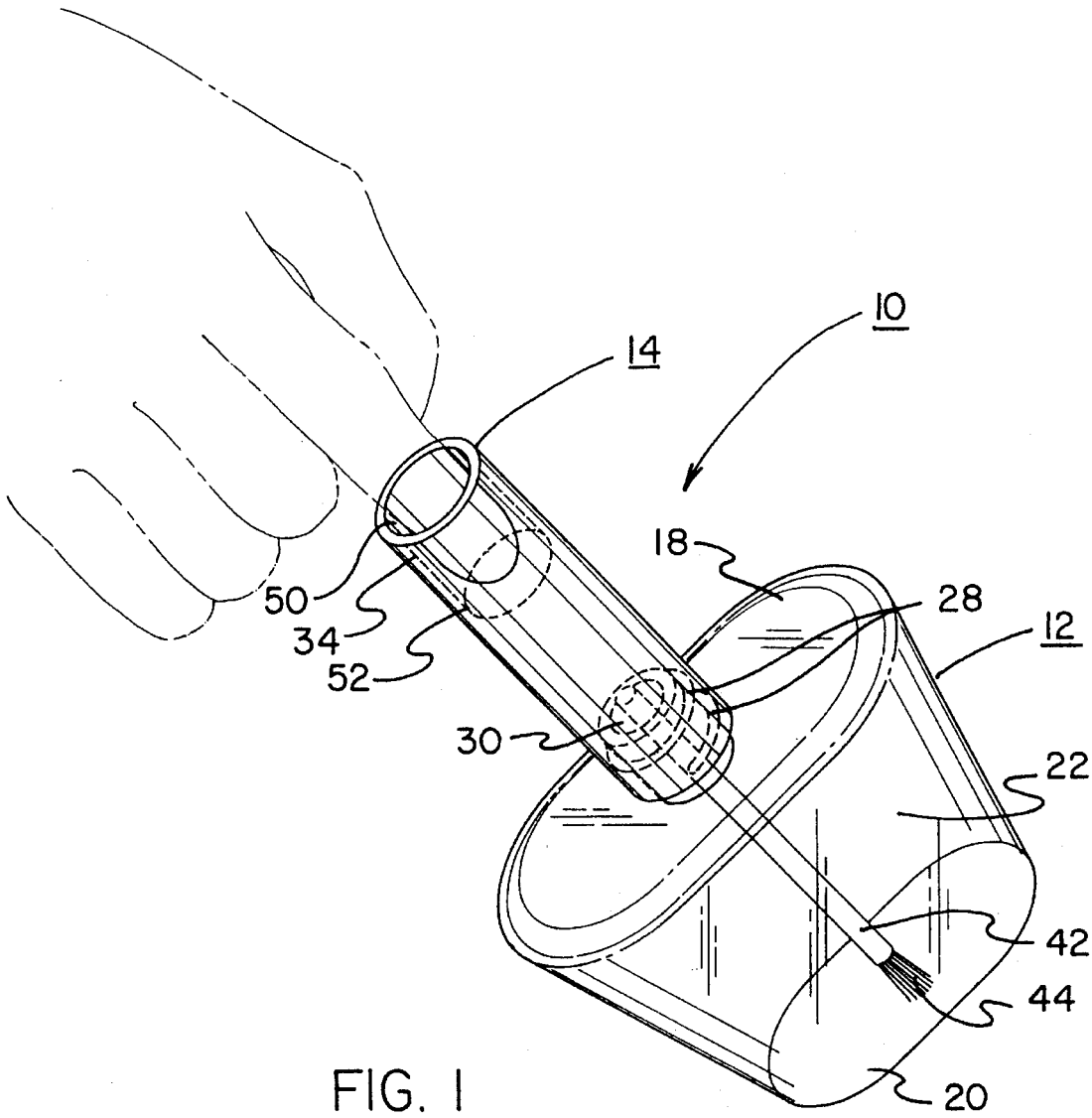
FIG. 1 is a perspective view of the preferred embodiment of the nail polish bottle with a color matching extension cap constructed in accordance with the principles of the present invention.

With reference now to the drawings, and in particular to FIG. 1 thereof, the preferred embodiment of the new and improved nail polish bottle with a color matching extension cap embodying the principles and concepts of the present invention and generally designated by the reference numeral 10 will be described.

The present invention, the nail polish bottle with a color matching extension cap 10 is comprised of a plurality of components. Such components in their broadest context include a nail polish bottle 12 and an extension cap 14. Such components are individually configured and correlated with respect to each other so as to attain the desired objective.

Figure 5:
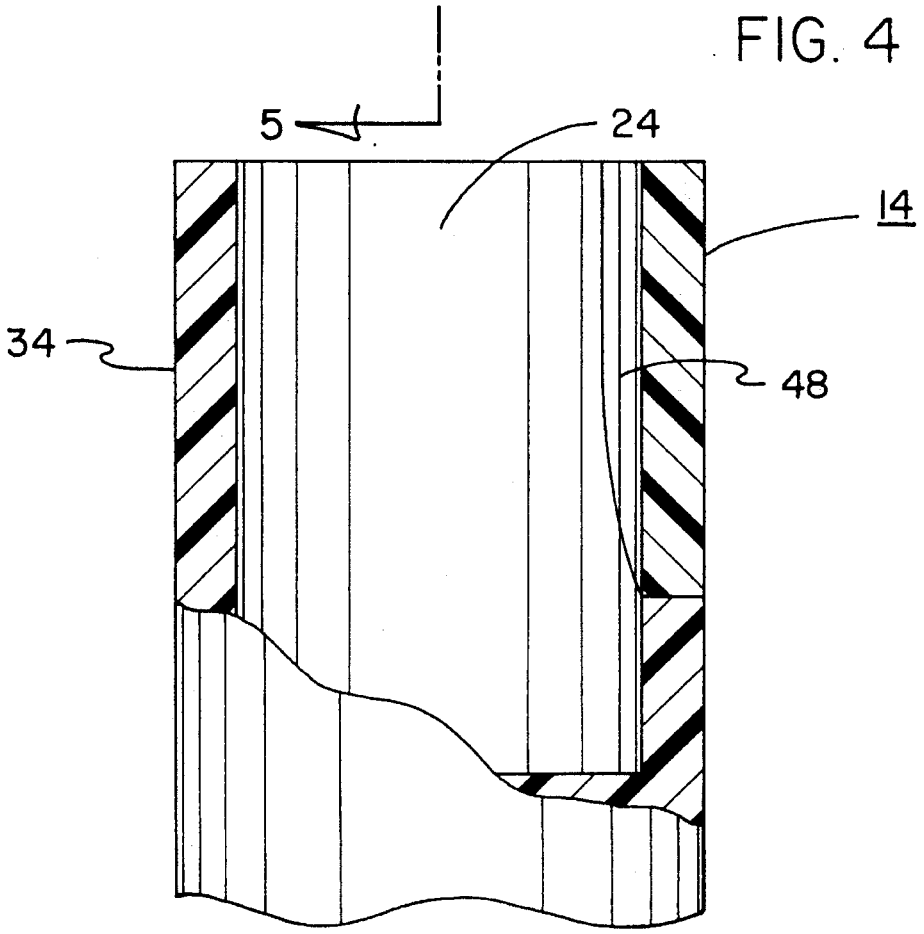
FIG. 5 is a cross sectional view of the apparatus taken along line 5—5 of FIG. 4.

More specifically, the nail polish bottle 12 has a roof 18, a floor 20 and a cylindrical side wall 22 extending therebetween. In alternative embodiments of the apparatus the bottle includes a plurality of sidewalls of varying shapes, sizes and designs. The roof 18 is formed in a planar generally oval configuration and has a circular aperture 24 at its center point. An upperwardly extending neck 26 is positioned around the aperture. The neck 26 is formed in a generally cylindrical configuration and has a plurality of external screw threads 28. The neck includes an axially positioned aperture 30 extending through it. The axial aperture permits communication between the interior of the bottle and the neck through the circular aperture in the roof. Note FIGS. 1 and 5.

Figure 2:
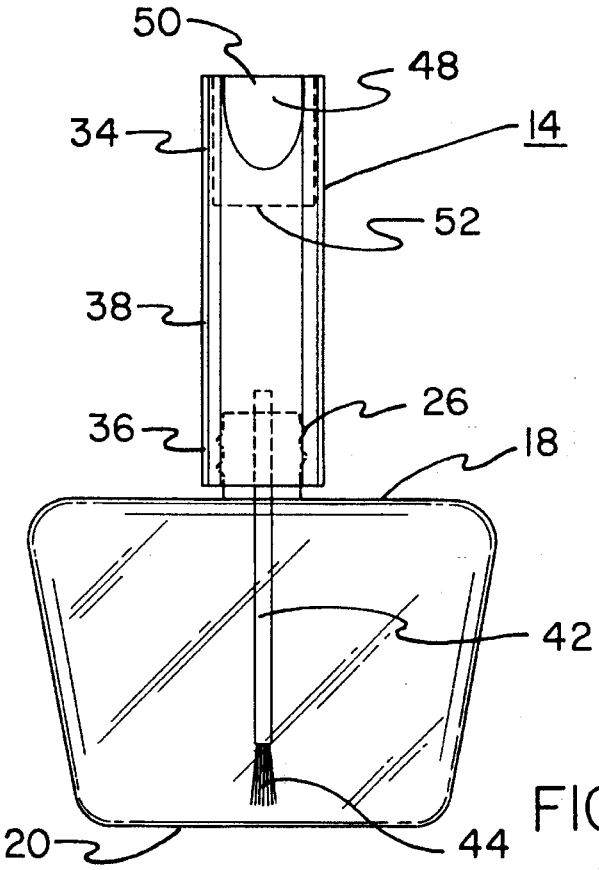
FIG. 2 is a front perspective view of the apparatus shown in FIG. 1.
Figure 3:
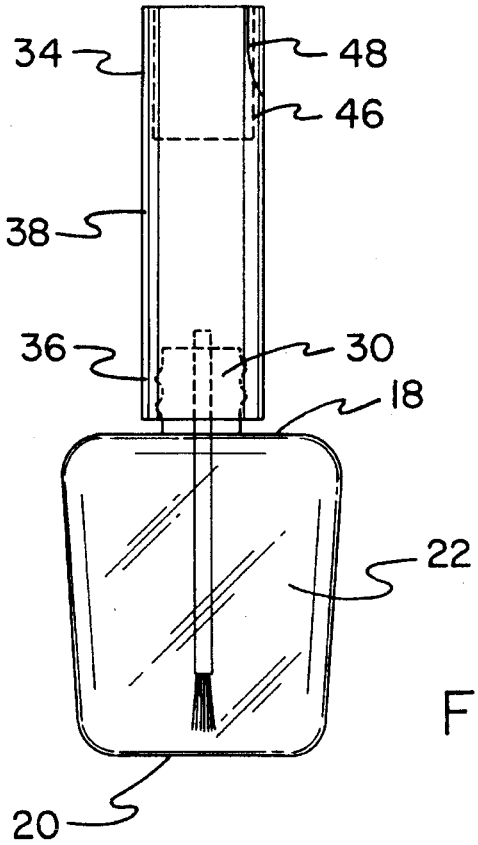
FIG. 3 is a side perspective view of the apparatus shown in FIG. 1.
Figure 4:
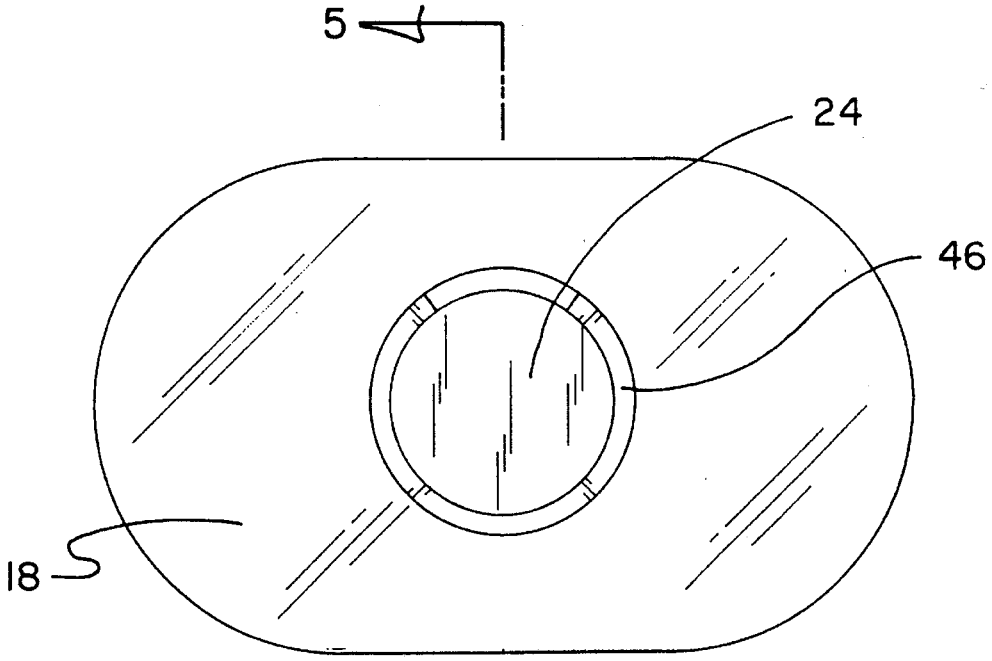
FIG. 4 is a top plan view of the apparatus shown in FIG. 1.

The neck is a standard size and configuration. In alternative embodiments of the bottle the neck is fabricated in a plurality of different sizes. The bottle is fabricated of a transparent material, either glass or plastic. The bottle is filled with a particular color of nail polish in the operative orientation. The transparent bottle enables the user to view the color of the nail polish through the bottle. Note FIGS. 2 and 3.

An extension cap 14 is formed in an elongated generally cylindrical configuration. The extension cap has an upper region 34, a lower region 36 and a central region 38 therebetween. The lower region has a plurality of internal screw threads. The lower region is adapted to be coupled to the neck of the bottle. In alternative embodiments of the apparatus the lower region is fabricated in a plurality of different sizes to permit coupling with differently sized nail polish bottles. Note FIGS. 1 and 2.

The central region 38 of the apparatus is solid. A brush 42 is formed in an elongated generally cylindrical configuration. The lowermost extent of the brush has a plurality of hairlike bristles 44 extending from it. The uppermost extent of the brush is affixed to the lowermost extent of the central region of the cap. The brush extends through the aperture in the roof and neck. The bristles are positioned in the lowermost extent of the nail polish bottle in the closed orientation. The brush is adapted to enable the user to apply nail polish to the finger nail of a person in a smooth and efficient manner. The user simply unscrews the extension cap and applies the polish to her nails in the usual manner. The long extension cap provides an excellent gripping surface for the user. Note FIGS. 1 and 3.

The upper region 34 of the extension cap has a hollow generally cylindrical sidewall 46. The upper region has an open end 50 at its uppermost extent and a closed end 52 at its lowermost extent. The open end of the upper region is sufficiently large to permit a user to comfortably insert any of her fingers therein. The closed end is formed contiguously with the uppermost extent of the solid central region. Note FIGS. 1 through 3.

The cylindrical sidewall includes a generally semi-oval shaped colored section 48 resembling a colored fingernail. The colored section is of the same hue as the nail polish in the bottle. In an alternative embodiment of the apparatus the sidewall is colored a hue that contrasts sharply with the nail polish. In a further alternative embodiment of the apparatus the sidewall is manufactured completely transparent and includes an area adapted to be painted in the hue of the users choice. The colored section is formed contiguously with the uppermost extent of the upper region. The apparatus enables the user to determine how a particular color of nail polish would look on their fingernail without having to paint the fingernail. The user simply inserts a finger and views the nail polish color as if it were painted on her fingernail. Note FIGS. 1, 2 and 5.

In a further alternative embodiment of the apparatus the cylindrical sidewall of the upper region is transparent. The upper region includes an insert formed in a hollow generally semispherical shaped configuration. The insert has an open end at its uppermost extent and a closed rounded end at its lowermost extent. The insert extends downwardly within the uppermost extent of the extension cap. The insert is colored the same hue as the nail polish in the bottle.

The nail polish bottle with a color matching extension cap allows the user to determine how a particular color of polish would look on the user's finger without actually painting it on. The apparatus saves time and results in customers being more satisfied with their chosen colors.

The product consists of a specially designed extension cap and a standard polish bottle. The cap is two to three times as long as a conventional cap and has a hole in its upper region. The end of the cap's upper region is colored the same hue as the polish inside the bottle. Both the shape of the hole and the colored section of the lid match the shape of a typical finger. The rest of the lid is either transparent or a color that contrasts that on the end of the lid.

When utilizing the apparatus the user first inserts the tip of one of her fingers in the hole in the upper region of the lid. This can be repeated for many different colors of polish. The colored end of the cap looks like a colored fingertip. The apparatus permits the user to see the color as it will appear on her own nails, while right next to her skin. All of this is done in an instant, without need to paint the nails.

The nail polish bottle with a color matching extension cap provides a quick and easy way to test whether a particular shade of nail polish will look good on a user's fingers. The apparatus eliminates the need for color charts or painting the client's nails before a purchase is made.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved nail polish bottle with a color matching extension cap, the apparatus comprising, in combination:

a nail polish bottle having a roof, a floor and a cylindrical side wall extending therebetween, the roof being formed in a planar generally oval configuration and having a circular aperture at its center point, an upwardly extending neck being positioned around the aperture, the neck being formed in a generally cylindrical configuration and having a plurality of external screw threads, the neck including an axially positioned aperture extending therethrough, the neck communicating with the interior of the bottle through the circular aperture in the roof, the bottle being fabricated of a transparent material, the bottle being filled with a particular color of nail polish, the transparent bottle enabling the user to view the color of the nail polish through the bottle;

an extension cap formed in an elongated generally cylindrical configuration, the extension cap having an upper region, a lower region and a central region therebetween, the lower region having a plurality of internal screw threads, the lower region adapted to be coupled to the neck of the bottle, the central region of the apparatus being solid, a brush being formed in an elongated generally cylindrical configuration, the lowermost extent of the brush having a plurality of hairlike bristles extending therefrom, the uppermost extent of the brush being affixed to the lowermost extent of the central region of the cap, the brush extending through the aperture in the roof and neck, the bristles being positioned in the lowermost extent of the nail polish bottle, the brush adapted to enable the user to apply nail polish to the fingernail of a person in a smooth and efficient manner the long extension cap providing a gripping surface for the user; and the upper region of the extension cap having a hollow generally cylindrical sidewall, the upper region having an open end at its uppermost extent and a closed end at its lowermost extent, the closed end being formed contiguously with the uppermost extent of the central region, the cylindrical sidewall including a generally semi-oval shaped colored section resembling a colored fingernail, the colored section being of the same hue as the nail polish in the bottle, the colored section being formed contiguously with the uppermost extent of the upper region, the apparatus enabling the user to insert a finger and determine how a particular color of nail polish would look on her fingernail without having to paint the fingernail.

* * * * *